US006944306B1

(12) United States Patent
Charbonneaux et al.

(10) Patent No.: US 6,944,306 B1
(45) Date of Patent: Sep. 13, 2005

(54) HARMONIC AMPLIFIER AND CORRESPONDING ELECTRO-ACOUSTIC TRANSDUCER

(75) Inventors: Marc Charbonneaux, Lyons (FR); Patrice Morchain, L'Isle d'Abeau (FR); Pierre Piccaluga, L'Isle d'Abeau (FR); Claude-Annie Perrichon, L'Isle d'Abeau (FR)

(73) Assignee: Pica-Sound International, Morrea (FR)

( * ) Notice: Subject to any disclaimer, the term of this patent is extended or adjusted under 35 U.S.C. 154(b) by 0 days.

(21) Appl. No.: 09/744,983

(22) PCT Filed: Jul. 22, 1999

(86) PCT No.: PCT/FR99/01807

§ 371 (c)(1),
(2), (4) Date: Apr. 16, 2001

(87) PCT Pub. No.: WO00/11910

PCT Pub. Date: Mar. 2, 2000

(30) Foreign Application Priority Data

Aug. 18, 1998 (FR) ..... 98 10596

(51) Int. Cl.[7] ..... H04R 3/00
(52) U.S. Cl. ..... 381/117; 381/401; 381/412
(58) Field of Search ..... 381/117, 400–401, 381/412, 120, 61, 98

(56) References Cited

U.S. PATENT DOCUMENTS

| | | | | |
|---|---|---|---|---|
| 3,766,334 | A * | 10/1973 | Burke | 381/117 |
| 4,443,731 | A | 4/1984 | Butler et al. | |
| 5,361,306 | A * | 11/1994 | Garcia | 381/98 |
| 5,748,758 | A | 5/1998 | Menasco et al. | |
| 5,917,922 | A * | 6/1999 | Kukurudza | 381/117 |
| 6,208,742 | B1 * | 3/2001 | Garcia et al. | 381/401 |
| 6,275,593 | B1 * | 8/2001 | Garcia et al. | 381/98 |
| 6,792,120 | B1 * | 9/2004 | Szenics | 381/120 |

FOREIGN PATENT DOCUMENTS

| | | |
|---|---|---|
| EP | 0 370 846 | 5/1990 |
| FR | 2 521 808 | 8/1983 |

* cited by examiner

*Primary Examiner*—Stella Woo
(74) *Attorney, Agent, or Firm*—Rothwell, Figg, Ernst & Manbeck

(57) ABSTRACT

A method of reproducing audio sound using low level electromagnetism applied to ambient air particles to create a new magnetic field. The method uses a device having at least one winding of electric wires that re wound onto a flexible polymer support. The impedance of the winding is 8 Ohms. The device is connected to an electric audio signal of an acoustic chamber or an acoustic supply. The device and method are useable with audio and audio-video systems, as well as other known methods of communication.

13 Claims, 1 Drawing Sheet

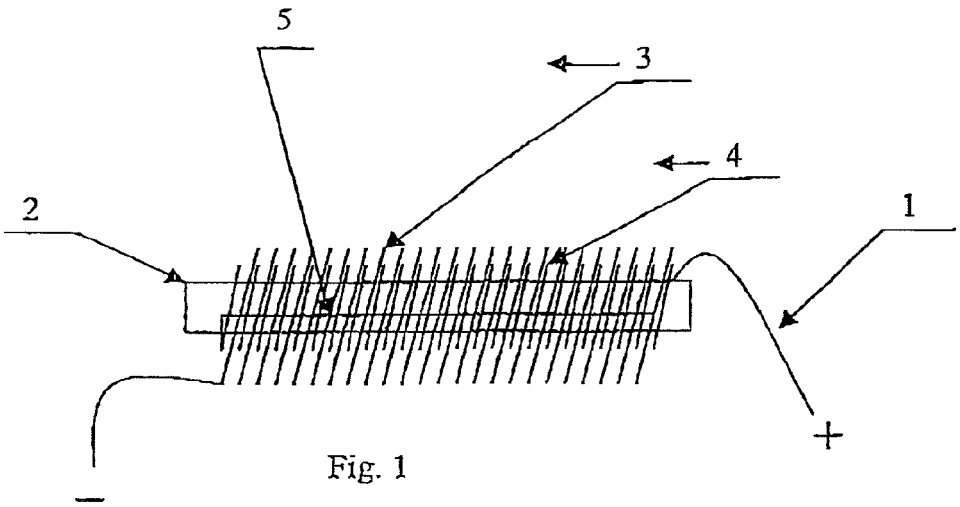
Fig. 1
Fig. 2
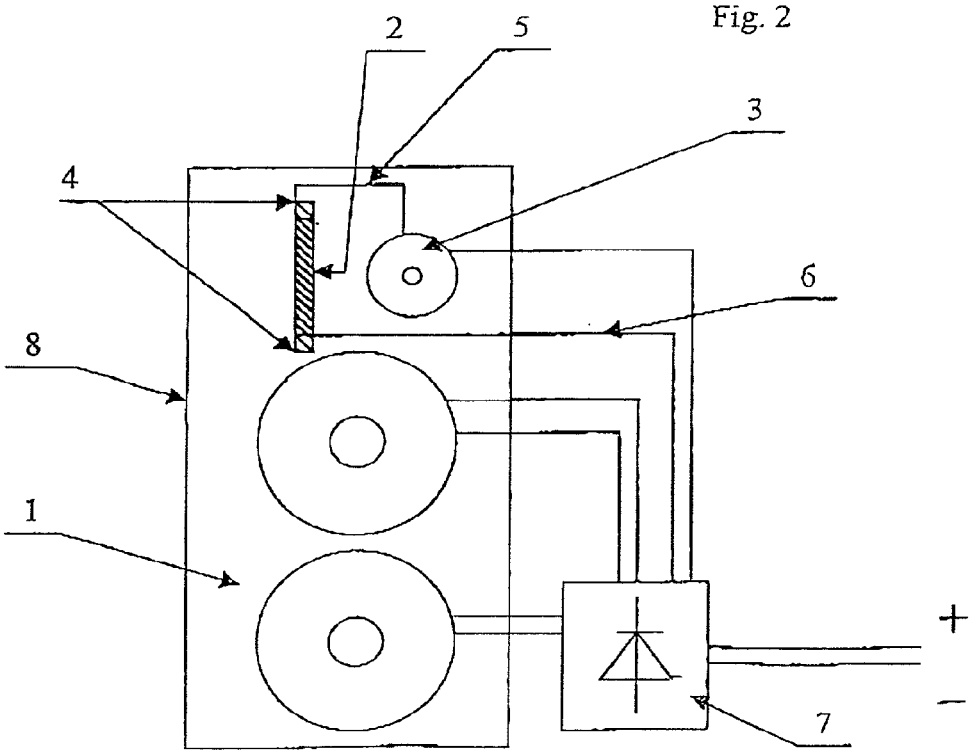

HARMONIC AMPLIFIER AND CORRESPONDING ELECTRO-ACOUSTIC TRANSDUCER

CROSS REFERENCE TO RELATED APPLICATION

This application is a 35 USC § 371 National Phase Entry Application from PCT/FR99/01807, filed Jul. 22, 1999, and designating the U.S.

In the field of sound reproduction, it is normal practice to use membranes excited by diamond motors or electrostatic strip systems.

It is normal to identify these products by acoustic efficiencies and acceleration speeds.

All these products have significant masses in movements to produce the sound. On the other hand, sound is an impact between air particles which have infinitely small masses conferring high sound propagation speeds, namely about 300 meters per second.

One product, such as the plasma chamber, was close to the physical performances of air since it acted on the level of the air particles. The drawback of this method was that it went through a chemical transformation of the composition of the air, and in order to do this, relatively expensive means were used.

The present method is a complement to current sound reproduction systems, such as the acoustic chambers used. These chambers create the required sound bases but are not refined and in particular have a characteristic defect in that they do not observe sound intermodulation. The present method and device superimpose on the coarse sound signal of the chambers the fine sound information contained in the original electric audio signal. This sound information has the precise order and amplification of space-time harmonics.

The present method uses low level electro-magnetism which is applied to the ambient air particles, thus creating a new magnetic field on the terrestrial magnetic field. Thus, the air particles are agitated by the new magnetic field which varies in opposition to the stable reference terrestrial magnetic field.

The new magnetic field is defined by the sole usage of at least one excited solenoid activated by the electric audio sound signal of an acoustic amplifier.

Thus, the present method amplifies the low-level sound harmonics, but to a larger extent for auditive perception and thus permit extremely clear sound reproduction. The speed of sound execution of this method is characterised by the absence of inertia and mechanical viscosity as it is executed by the solenoid without any apparent mechanical movement. Sound emission is therefore effected by firstly agitating the molecules in space, and secondly, according to the types of methods of winding, can be effected by the sound micro-vibrations of electric wires or solenoids.

A variant of the method is a solenoid added to at least one magnet inside or outside which has its effect but reduces its sensitivity owing to the residual magnetism of the magnetic field of the magnet which imposes its magnetic field constant masking the terrestrial magnetic field.

This method is characterised by a device made up (FIG. 1) of at least one winding of electric wires (1) in this figure, 1/10th of a millimeter being wound onto a flexible polymer support (2) 10 cm long and having a diameter of 0.8 cm. The impedance of this winding is 8 Ohms and winding is characterised in that each layer (3,4) is wound in the same winding direction, the return wire (5) being placed along the winding. This winding method allows micro-vibrations between the spires given the fact of the tension difference between the spires of the first and second layer. These micro-vibrations take part in the sound amplification of the harmonics. This device is connected to an electric audio signal of an acoustic chamber or an acoustic supply. This device complements normal electro-acoustic transducers. This device is produced by a specialist in this field and represents a non-restrictive example of the embodiment of this method. This device (FIG. 1) is integrated (FIG. 2) in an acoustic chamber (8) in front of the facade (1). The electro-acoustic transducer solenoid (2) of the present device is mounted free in the ambient air next to the Tweeter (3). It is mounted on the facade and supported mechanically by two screws (4) and is mounted electrically with the Tweeter (3) by the electric wires (5, 6) derived from the electro-acoustic filter (7). The winding of the electric wire can have any type of shape, having for example a round, conical or square section or take any other shape. This mounting does not restrict the applications of the device. This new electro-acoustic transducer could be mounted directly on the general audio power supply between the amplifier and the acoustic chamber.

These new electro-acoustic transducers can be mounted in series or in parallel or both.

These acoustic transducers are harmonic amplifiers.

The present method and electro-acoustic device limited to a winding of a no-membrane electric wire provide unequalled acoustic fineness. Several windings of one onto another also constitute an electro-acoustic transducer of the same type as the one submitted in the present method but whose embodiment is more complex.

This device and method can be used on all audio and audio-video systems and in any method of communication, such as telephones, radio, as well as by the medical profession for improving the auditive comfort of deaf persons.

What is claimed is:

1. A device that improves an audio sound emitted by at least one acoustic baffle, comprising:

means for superimposing on the audio sound refined sound information contained in a source signal of the audio sound; and at least one coil of wire in free ambient air to which is supplied an electric signal which is the same as the audio signal the device delivers to the at least one baffle, wherein the device is adapted to provide a harmonic amplifying electro-acoustic transducer to supplement at least one of electro-acoustic baffles and a transducer.

2. The device according to claim 1, further comprising:

at least one magnet to augment magnetic field effects.

3. The device according to claim 1, further comprising:

a solenoid having at least one magnet on either one of an exterior or interior of the solenoid, the at least one magnet imposing a constant magnetic field to mask the terrestial magnetic field, wherein the at least one magnet activates an effect of the solenoid and diminishes a sensitivity of the solenoid.

4. The device according to claim 1, further comprising:

at least one coil of electric wire wound on a flexible polymer base.

5. The device according to claim 4, wherein the at least one coil of electric wire has a diameter of 1/10 of a millimeter, the polymer base is 10 centimeters long and 0.8 centimeter in diameter, and an impedance of the at least one coil of electric wire is 8 ohms.

6. The device according to claim 1, further comprising:

a coil having a first and second layers having a same direction of winding, a return wire being placed along the winding that allows microvibrations to occur between turns of the winding, the first and second layers having different voltages between the turns.

7. The device according to claim 1 integrated into a facade of an acoustic chamber.

8. The device according to claim 1, wherein an electro-acoustic transducer solenoid is mounted free-standing in ambient air beside a tweeter and before a facade, the electro transducer solenoid being fastened by mechanical means and mounted electrically to the tweeter by electric wires from an electro-acoustic filter.

9. The device according to claim 1, wherein the at least one coil of electric wire has any one of a round, conical, or square cross-section.

10. The device according to claim 1, wherein the device is mounted directly onto a general audio feed between an amplifier and the at least one baffle.

11. The device according to claim 1, wherein a plurality of such devices are mounted either one of serially, in parallel, or both.

12. The device according to claim 1, comprising either one of one coil of electric wire without a diaphragm or several coils atop one another.

13. The device according to claim 1 to supplement any one of audio and audio-video systems and means of communication to improve auditory comfort.

* * * * *